US006053474A

United States Patent [19]

Stucke, Jr. et al.

[11] Patent Number: 6,053,474

[45] Date of Patent: Apr. 25, 2000

[54] VENT VALVE

[75] Inventors: Donald W. Stucke, Jr., Campbell; Pascal Golay, Brooklyn, both of N.Y.; William Thomas Kearney, III, Lexington, Ky.

[73] Assignee: Corning Consumer Products Company, Corning, N.Y.

[21] Appl. No.: 09/153,185

[22] Filed: Sep. 16, 1998

[51] Int. Cl.[7] ..... B65D 51/18

[52] U.S. Cl. ..... 251/299; 219/735; 220/367.1; 99/DIG. 14; 428/118

[58] Field of Search ..... 251/299; 219/735; 220/367.1; 99/DIG. 14; 428/118

[56] References Cited

U.S. PATENT DOCUMENTS

| | | | |
|---|---|---|---|
| 3,716,180 | 2/1973 | Bemiss et al. | 426/118 X |
| 3,727,789 | 4/1973 | Rieber, Jr. et al. | 220/367.1 X |
| 4,345,695 | 8/1982 | Galloway et al. | 220/367.1 X |
| 4,361,310 | 11/1982 | Cummins | 251/299 X |
| 4,640,838 | 2/1987 | Isakson et al. | 220/367.1 X |
| 4,992,636 | 2/1991 | Namiki et al. | 219/735 |
| 5,310,081 | 5/1994 | McCabe | 220/367.1 X |
| 5,363,978 | 11/1994 | Molo | 220/367.1 X |
| 5,462,185 | 10/1995 | Walker, III | 220/367.1 X |
| 5,523,236 | 6/1996 | Nuzzo | 220/367.1 X |
| 5,692,616 | 12/1997 | Baker | 220/367.1 X |
| 5,747,082 | 5/1998 | Floyd et al. | 426/109 |
| 5,750,967 | 5/1998 | Sprauer, Jr. | 219/735 |
| 5,762,228 | 6/1998 | Morgan et al. | 220/367.1 |
| 5,780,824 | 7/1998 | Matos | 220/367.1 X |

*Primary Examiner*—John Rivell

*Attorney, Agent, or Firm*—Robert A. Koons, Jr.; Kenneth Crimaldi; Pepper Hamilton LLP

[57] ABSTRACT

The invention is a valve for a microwavable container having a flexible lid. The valve has two posts extending from one side of a body member, and the posts correspond to two apertures in the lid. The cross-sectional area of the posts are larger than the apertures in the lid, and the distal portions of the posts are larger than the proximal portions. When the posts are engaged with the apertures a liquid-tight seal is formed. One post can be removed from its corresponding aperture to create a vent for microwave cooking, while the other post remains engaged with the lid to anchor the valve to the lid. The body portion of the valve extends beyond the vent post and preferably flares upwardly and fans laterally to form a tab to facilitate opening of the vent. The body portion also preferably has a thin between the posts in a direction substantially perpendicular to the line of the posts to facilitate hinging of the valve.

10 Claims, 1 Drawing Sheet

VENT VALVE

FIELD OF THE INVENTION

The invention relates to a vent valve for use on microwavable food containers.

BACKGROUND OF THE INVENTION

Conventional sealable containers capable of being used in microwave ovens are often equipped with a valve for releasing pressure that can build up in the sealed container during microwave heating. Many known valves are structures permanently or removably attached to a container lid. The valves are engagable with a vent opening in the lid to form a seal for food storage purposes, and can be disengaged to expose the vent opening during microwave heating.

A disadvantage of known valve structures is that they can trap debris and be difficult to clean, particularly if they cannot be removed from the lid structure. Even if the valve is completely removable from the lid, the anchoring structures for known valves (on the lid and/or on the valve itself) are relatively intricate and present cleaning difficulties.

SUMMARY OF THE INVENTION

Briefly, the invention is a valve for a microwavable container having a flexible lid. The valve has two posts extending from one side of a body member, and the posts correspond to two apertures in the lid. The cross-sectional area of the posts are larger than the lid apertures, and the distal portions of the posts are larger than the proximal portions. A liquid-tight seal is formed when the posts are engaged with the lid apertures. One post can be removed from its corresponding aperture to create a vent for microwave cooking, while the other post remains engaged with the lid to anchor the valve to the lid. The anchor post is preferably circular in cross-section. The body portion of the valve extends beyond the vent post and preferably curves upwardly (in the direction opposite to the direction in which the posts project) and fans laterally to form a graspable tab to facilitate opening of the vent. The tab preferably has a plurality of bumps to facilitate grasping. The body portion is also preferably thinner between the posts in a direction substantially perpendicular to the line of the posts to facilitate hinging of the valve.

DETAILED DESCRIPTION OF THE INVENTION

Figure 1:
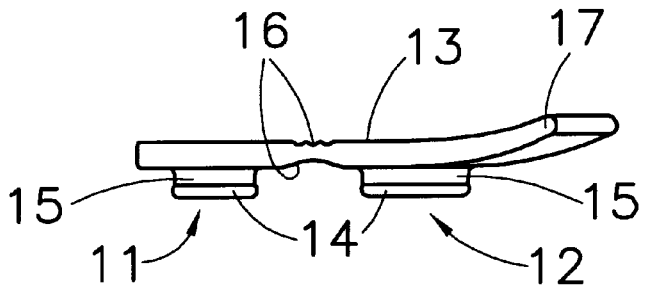
FIG. 1 is a perspective view of a valve in accordance with the invention.

Applicants have discovered a vent valve for a food container lid that is especially easy to remove and clean. The valve employs an elegantly simple attachment mechanism that is easily removed and cleaned, and requires no intricate structures on the lid for attachment. The invention comprises two posts, an anchor post and a vent post, attached to a body member. The posts correspond to two holes in a flexible lid, the two holes being spaced and shaped like the posts. The cross-sectional area of the posts' distal and proximal portions ("distal" and "proximal" relative to the body member) are both larger than the area of the corresponding holes, while the cross-sectional areas of the posts' distal portions are larger than the cross-sectional area of the proximal portions. The length of the posts is greater than the thickness of the lid at the engagement holes, and the distal portions of the posts project beyond the interior lid face to help secure the valve to the lid. Thus, when the valve is engaged with the lid, the body member is adjacent to the exterior lid face, the distal portions of the posts project beyond the interior lid face, and the proximal portions of the posts (between the distal portions of the posts and the body member) press against lid portions defining the holes to form a liquid-tight seal. The vent post can be disengaged from the lid without disengaging the anchor post from the lid, thereby enabling venting of the container without removal of the valve from the lid.

The body member projects beyond the vent post (in the direction opposite from the anchor post) to provide a tab that can be grasped to apply the force required to pull the vent post free of the vent hole. Preferably, the tab curves upwardly (in the direction opposite from the post projection direction) and fans laterally to provide a larger and more easily grasped structure. The tab also preferably has raised bumps to improve the user's grip on the tab.

The anchor post is preferably cylindrical in shape (with the distal portion still having a larger cross-sectional area than the proximal portion), though other anchor post shapes can be used. In an alternative embodiment, an anchor post could project from the exterior face of the lid itself, and the vent valve would have a hole to accommodate the anchor post projecting from the lid.

Preferably, the valve is thinner on the body member between the posts to facilitate hinging of the valve. The hinging facilitates the removal of the vent post from the lid without the simultaneous removal of the anchor post.

The material used for the invention is not particularly limited, so long as it provides adequate flexibility for engagement/disengagement of the posts with the lid, and disengagement of the vent post while the anchor post remains engaged. Examples of suitable materials include flexible thermoplastic or flexible thermoset material.

The invention will now be described with reference to drawings illustrating a preferred embodiment. The drawings are not intended to limit the scope of the invention defined in the appended claims.

FIG. 1 is an side elevation view of a vent valve in accordance with the invention. Anchor post 11 and vent post 12 project from the bottom face of body member 13. The distal portions 14 of posts 11 and 12 are slightly wider than proximal portions 15. When engaged with a microwavable container lid, body member 13 is adjacent to the exterior face of the lid, distal portions 14 project from the interior face of the lid, and proximal portions 13 press against the portions of the lid defining the anchor and vent holes to form a liquid-tight seal. Thin portion 16 on body member 13 facilitates hinging of the valve. The end portion of body member 13 extending beyond vent post 12 can be seen flaring upwardly to form a graspable tab 17 that facilitates disengagement of vent post 12 from a lid.

Figure 2:
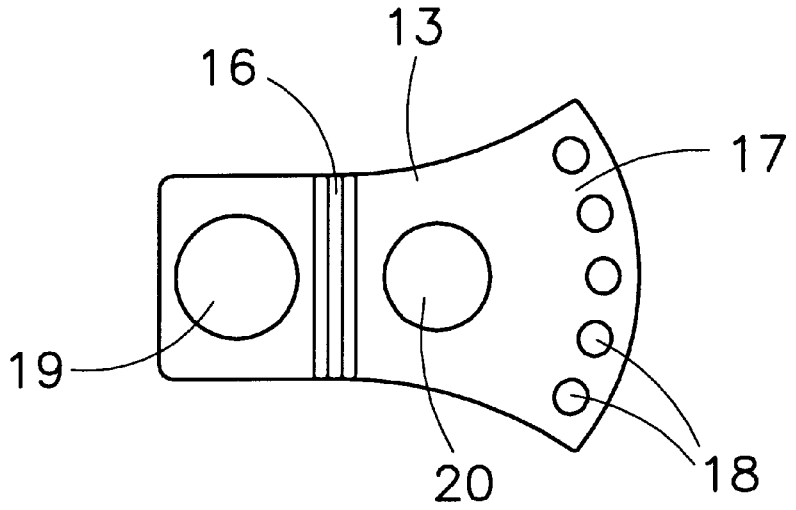
FIG. 2 is a top plan view of the valve shown in FIG. 1.

FIG. 2 is a top plan view of the valve shown in FIG. 1. The top face of body member 13 has score lines indicating the position of thin portion 16. Tab 17 can be seen fanning laterally to provide a larger structure for grasping. Raised bumps 18 on tab 17 improve a users grip on tab 17. Indentations 19 and 20 provide a visual cue to the user of the positions of anchor post 11 and vent post 12, respectively, thereby aiding in alignment of the posts with the corresponding lid holes for engagement purposes.

As described above, the valve of the invention provides an elegantly simple design that eliminates intricate, difficult to clean attachment structures on the valve itself and on the container lid.

Though the invention has been described above with reference to specific embodiments, other embodiments of the invention can readily be envisioned by one of ordinary skill in the art in light of this teaching. Modifications, substitutions, changes and/or omissions may be made without departing from the spirit and scope of the invention defined in the appended claims.

We claim:

1. A removable vent valve for a container, said vent valve comprising:

a body member having top and bottom opposing sides and a tab portion;

an anchor post projecting from bottom opposing side, said anchor post having portions distal and proximal to said body member, said distal portion having a cross-sectional area greater than said proximal portion;

a vent post projecting from said bottom opposing sides, said vent post being spaced from said anchor post along an axis and positioned between said anchor post and said tab portion, said vent post having portions distal and proximal to said body member, said distal portion having a cross-sectional area greater than said proximal portion;

wherein said body member projects beyond said vent post in a direction opposite from said anchor post to provide said tab portion; and wherein said body member is substantially planar and said tab portion curves out of said body member plane in the direction opposite to the projection direction of said anchor and vent posts.

2. The vent valve according to claim 1, wherein said body member further comprises a thin portion between said anchor post and said vent post, said thin portion extending in a substantially perpendicular direction relative to said axis.

3. The vent valve according to claim 1, wherein said tab portion gradually widens in the direction perpendicular to said axis.

4. The vent valve according to claim 2, wherein said tab portion gradually widens in the direction perpendicular to said axis.

5. The vent valve according to claim 1, further comprising indentations on said top opposing side that correspond to the position of said anchor and vent posts on said bottom opposing side.

6. The vent valve according to claim 4, further comprising indentations on said top opposing side that correspond to the position of said anchor and vent posts on said bottom opposing side.

7. The vent valve according to claim 1, further comprising a plurality of raised bumps on said top opposing side of said tab portion.

8. The vent valve according to claim 6, further comprising a plurality of raised bumps on said top opposing side of said tab portion.

9. The vent valve according to claim 1, wherein the anchor post has a cylindrical shape.

10. The vent valve according to claim 8, wherein the anchor post has a cylindrical shape.

* * * * *